United States Patent [19]

George et al.

[11] Patent Number: 4,881,282

[45] Date of Patent: Nov. 21, 1989

[54] ADJUSTABLE SHOWER HEAD

[76] Inventors: Edward J. George; Frances George, both of Box 245, Fernie, Canada, V0B 1M0

[21] Appl. No.: 230,356

[22] Filed: Aug. 10, 1988

[51] Int. Cl.[4] ..... A47K 3/22

[52] U.S. Cl. ..... 4/604; 4/570; 4/605; 74/500.5; 74/502.1; 239/578

[58] Field of Search ..... 4/567, 570, 596, 601, 4/597, 604, 605, 612, 615, 619, DIG. 7, 191; 74/500.5, 501.6, 502.1; 239/578, 587, 588

[56] References Cited

U.S. PATENT DOCUMENTS

| | | | |
|---|---|---|---|
| 1,219,049 | 3/1917 | Sticklin | 239/588 |
| 1,583,944 | 5/1926 | Van Eweyk | 4/191 |
| 1,630,217 | 5/1927 | Rasor | 74/502.1 |
| 2,698,665 | 1/1955 | Freeman | 239/578 |
| 2,857,201 | 10/1958 | Palmer | 239/587 |
| 2,928,318 | 3/1960 | Friday | 74/502.1 |
| 3,206,126 | 9/1965 | Thompson | 239/578 |
| 3,587,872 | 6/1971 | Pauly | 74/500.5 |
| 3,685,745 | 8/1972 | Pescheke-Koedt | 4/596 |
| 4,084,886 | 4/1978 | Grosch et al. | 74/502.1 |
| 4,271,543 | 6/1981 | Martin | 4/596 |
| 4,273,289 | 6/1981 | Jette | 239/578 |
| 4,282,612 | 8/1981 | King | 4/596 |
| 4,360,159 | 11/1982 | Haynes | 239/282 |
| 4,398,668 | 8/1983 | Jette | 239/414 |
| 4,459,870 | 7/1984 | Gill et al. | 74/501.6 |

*Primary Examiner*—Henry J. Recla
*Assistant Examiner*—J. Casimer Jacyna
*Attorney, Agent, or Firm*—Jerry T. Kearns

[57] ABSTRACT

A pivotal shower head is provided with a remotely actuatable directional control mechanism. A directional control yoke is mounted on a ball and socket pivotally adjustable shower head mounted within a protective housing. Four control cables are mounted at ninety degree intervals around the directional control yoke. The cables are each received for longitudinal movement within individual cable sheaths. The cable sheaths extend within a rigid tube to a remotely located joystick control housing. A master control yoke is connected to a ball and socket pivotally mounted joystick. Ends of the control cables are mounted at ninety degree intervals to the master control yoke. The pivotal shower head is adjusted by tensioning of the individual cables in response to movement of a joystick control lever. The joystick control housing has an upper surface provided with a receptacle for use as a soap dish.

4 Claims, 4 Drawing Sheets

ADJUSTABLE SHOWER HEAD

BACKGROUND OF THE INVENTION

1. Field of the Invention

The present invention relates to adjustable shower heads, and more particularly pertains to a new and improved mechanism for allowing remote directional adjustment of a shower head. Handicapped individuals and small children are unable to adjust the spray head direction of conventional pivotally mounted shower heads. In order to solve this problem, the present invention provides an inexpensive remote actuation device for providing directional control of a pivotally mounted shower head.

2. Description of the Prior Art

Various types of adjustable shower heads are known in the prior art. A typical example of such an adjustable shower head is to be found in U.S. Pat. No. 3,685,745, which issued to A. Pescheke-Koedt on Aug. 22, 1972. This patent discloses a shower head which is mounted for compound manual adjustment. U.S. Pat. No. 4,271,543, which issued to J. Martin on June 9, 1981, discloses a shower head which is mounted for vertical adjustment on a continuous chain received around two vertically spaced pulleys. U.S. Pat. No. 4,282,612, which issued to J. King on Aug. 11, 1981, discloses an adjustable shower head which is mounted on a series of contiguous pipe members each connected by a universal joint. A handle secured to one of the pipes allows manual adjustment of the shower head. U.S. Pat. No. 4,360,159, which issued to J. Haynes on Nov. 23, 1982, discloses an adjustable shower head which is connected to a water supply by an elongated flexible hose. The shower head is mounted in a vertically extending track for manual vertical adjustment. A pair of spaced pulleys mount the shower head within the vertical track. U.S. Pat. No. 4,398,668, which issued to E. Jette on Aug. 16, 1983, discloses an adjustable shower head which utilizes a pivotally mounted shower head provided with an elongated arm having an adjustment control knob. The pivotal adjustment mounting includes a flow control valve to shut off the water flow in a selected adjusted position.

While the above mentioned devices are suited for their intended usage, none of these devices provide for the remote adjustment of a shower head by handicapped individuals. Additionally, none of the previously described adjustable shower heads utilizes a remotely mounted joystick in conjunction with a cable linkage to allow remote adjustment of a shower head. Inasmuch as the art is relatively crowded with respect to these various types of adjustable shower heads, it can be appreciated that there is a continuing need for and interest in improvements to such adjustable shower heads, and in this respect, the present invention addresses this need and interest.

SUMMARY OF THE INVENTION

In view of the foregoing disadvantages inherent in the known types of adjustable shower heads now present in the prior art, the present invention provides an improved adjustable shower head. As such, the general purpose of the present invention, which will be described subsequently in greater detail, is to provide a new and improved adjustable shower head which has all the advantages of the prior art adjustable shower heads and none of the disadvantages.

To attain this, a representative embodiment of the concepts of the present invention is illustrated in the drawings and makes use of a pivotal shower head provided with a remotely actuatable directional control mechanism. A directional control yoke is mounted on a ball and socket pivotally adjustable shower head mounted within a protective housing. Four control cables are mounted at ninety degree intervals around the directional control yoke. The cables are each received for longitudinal movement within individual cable sheaths. The cable sheaths extend within a rigid tube to a remotely located joystick control housing. A master control yoke is connected to a ball and socket pivotally mounted joystick. Ends of the control cables are mounted at ninety degree intervals to the master control yoke. The pivotal shower head is adjusted by tensioning of the individual cables in response to movement of a joystick control lever. The joystick control housing has an upper surface provided with a receptacle for use as a soap dish.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable shower head which has all the advantages of the prior art adjustable shower heads and none of the disadvantages.

It is another object of the present invention to provide a new and improved adjustable shower head which may be easily and efficiently manufactured and marketed.

It is a further object of the present invention to provide a new and improved adjustable shower head which is of a durable and reliable construction.

An even further object of the present invention is to provide a new and improved adjustable shower head which is susceptible of a low cost of manufacture with regard to both materials and labor, and which accordingly is then susceptible of low prices of sale to the consuming public, thereby making such adjustable shower heads economically available to the buying public.

Still yet another object of the present invention is to provide a new and improved adjustable shower head which provides in the apparatuses and methods of the prior art some of the advantages thereof, while simultaneously overcoming some of the disadvantages normally associated therewith.

Still another object of the present invention is to provide a new and improved adjustable shower head which allows remote directional adjustment of a pivotally mounted shower head by handicapped individuals and small children.

Yet another object of the present invention is to provide a new and improved adjustable shower head which may easily be retrofitted to existing conventional shower enclosures.

Even still another object of the present invention is to provide a new and improved adjustable shower head which utilizes a remote joystick control housing which also serves as a soap dish.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
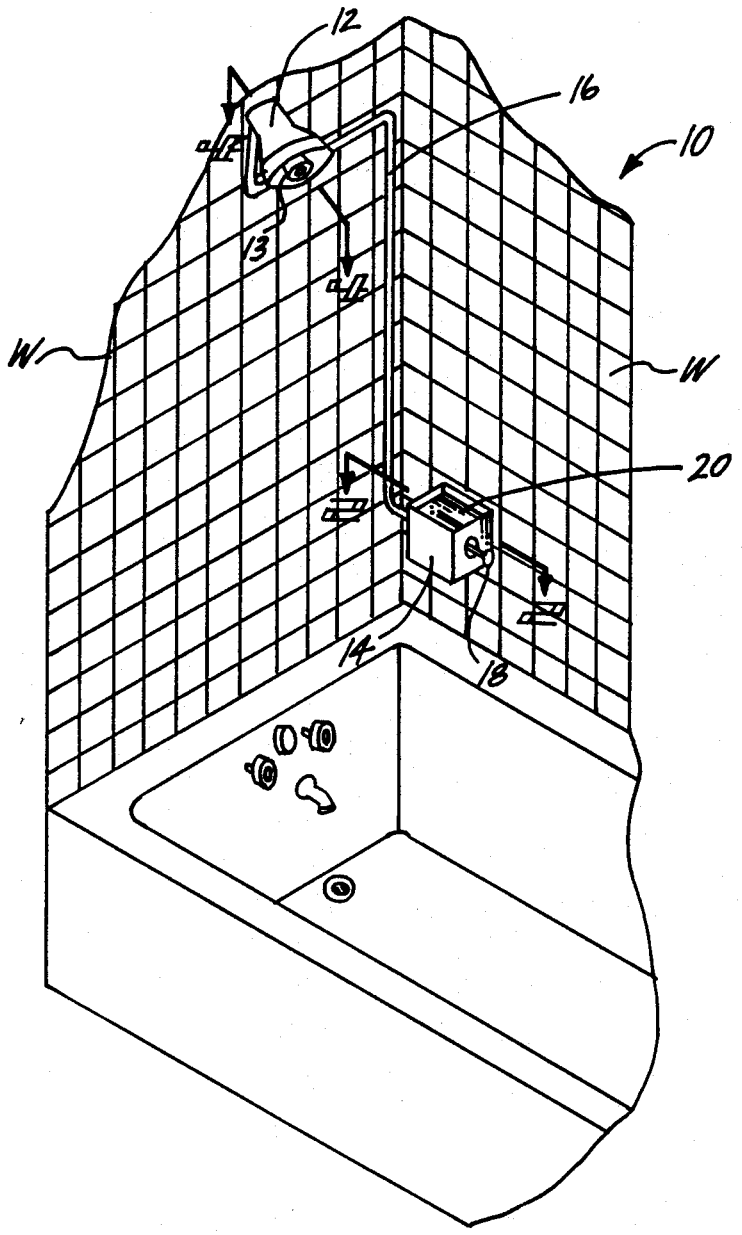
FIG. 1 is a perspective view of the adjustable shower head of the present invention installed in a shower enclosure.

With reference now to the drawings, and in particular to FIG. 1 thereof, a new and improved adjustable shower head embodying the principles and concepts of the present invention and generally designated by the reference numeral 10 will be described.

More specifically, it will be noted that the first embodiment 10 of the invention includes a stationary shower head housing 12 having an open front portion through which a pivotally mounted adjustable shower head 13 extends. An elongated hollow rigid tube 16 extends between the shower head housing 12 and a remotely mounted remote control housing 14. A pivotally mounted joystick 18 extends exteriorly of the remote control housing 14. A soap receptacle 20 is formed on an upper surface of the remote control housing 14.

Figure 2:
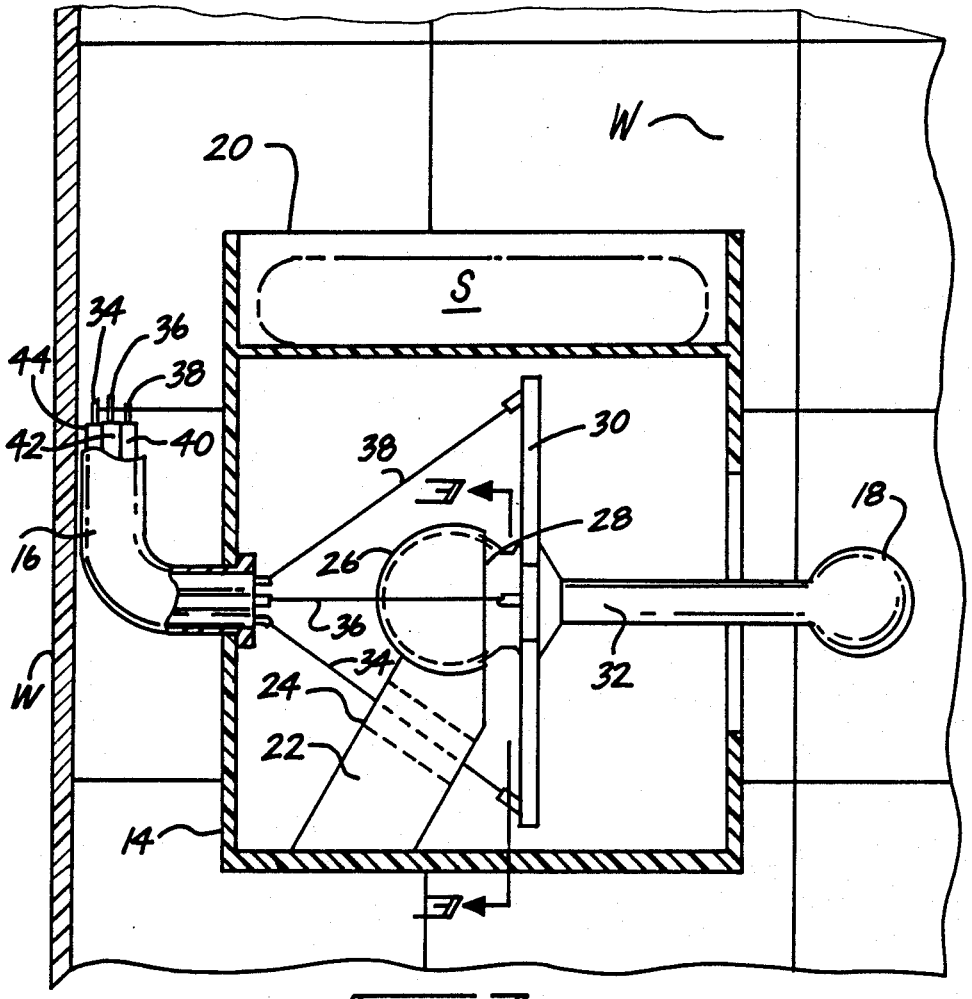
FIG. 2 is a cross sectional view, taken along line 2—2 of FIG. 1, which illustrates the internal construction of the remote joystick control housing.

With reference now to FIG. 2, the constructional details of the remote control housing 14 will now be described. The rigid tube 16 has a lower end which communicates with the interior of the housing 14. A support standard 22 extends upwardly from a floor portion within the housing 14 and supports a pivot socket 26. A pivot ball 28 is formed at an inner end of a joystick control lever 32. The joystick control lever 32 extends exteriorly through an aperture formed in a side wall of the housing 14 and terminates in a control knob 18. A conventional flexible sealing boot may be provided around the lever 32 to prevent entrance of water into the housing 14. A master yoke 30 is secured to the joystick control lever 32 within the housing 14. The joystick control lever 30 may be in the form of a cross having four arm portions spaced in a common plane at ninety degree intervals. Alternatively, the master yoke 30 may be formed as a square plate. Four control cables have their lower ends secured in a common plane at ninety degree intervals around the control yoke 30. Three of the four control cables 34, 36 and 38 may be seen in FIG. 2. The four control cables are each received within a fixed cable sheath which extends within the interior of the rigid tube 16. The cable sheaths provide a low friction mounting which allows reciprocal sliding movement of each of the control cables. Three of the four cable sheaths 40, 42 and 44 are illustrated in FIG. 2. As may now be readily understood, manipulation of the control knob 18 causes movement of the pivot ball 28 within the socket 26 an results in movement of the master yoke 30. For example, movement of the control knob 18 upwardly, as illustrated in FIG. 2, causes a tensioning of the cable 34. Similarly, downward movement of the control knob 18 causes a tensioning of the cable 38. The control cable 34 is received through a clearance aperture 24 formed through the support standard 22. Alternatively, the support standard 22 may extend between any two of the control cables and be angularly secured on a side wall of the housing 14. As previously described, a receptacle 20 formed on an upper surface of the housing 14 is adapted for use as a soap dish to receive a conventional bar of soap S. The remote control housing 14 may be secured by conventional fastening means on any of the walls W of the shower enclosure. The housing 14 may be positioned as desired to enable usage by small children and handicapped individuals. It is to be understood that the lengths of the rigid tube 16, control cables and cable sheaths will be adjusted during installation, dependent upon the desired location of the housing 14.

Figure 3:
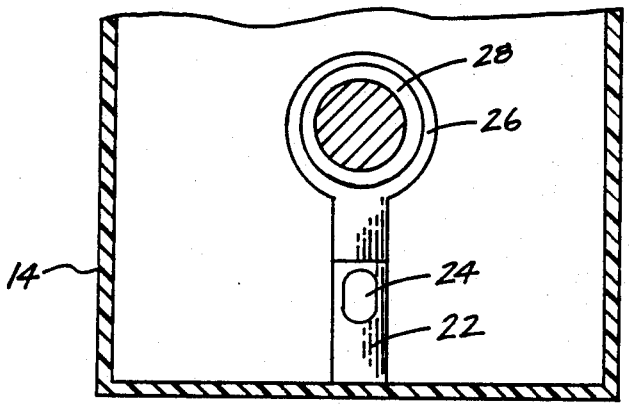
FIG. 3 is a partial cross sectional view, taken along line 3—3 of FIG. 2, which illustrates the ball and socket joystick mounting.

In FIG. 3, a cross sectional view taken along line 3—3 of FIG. 2 illustrates the support standard 22, pivot socket 26 and pivot ball 28.

Figure 4:
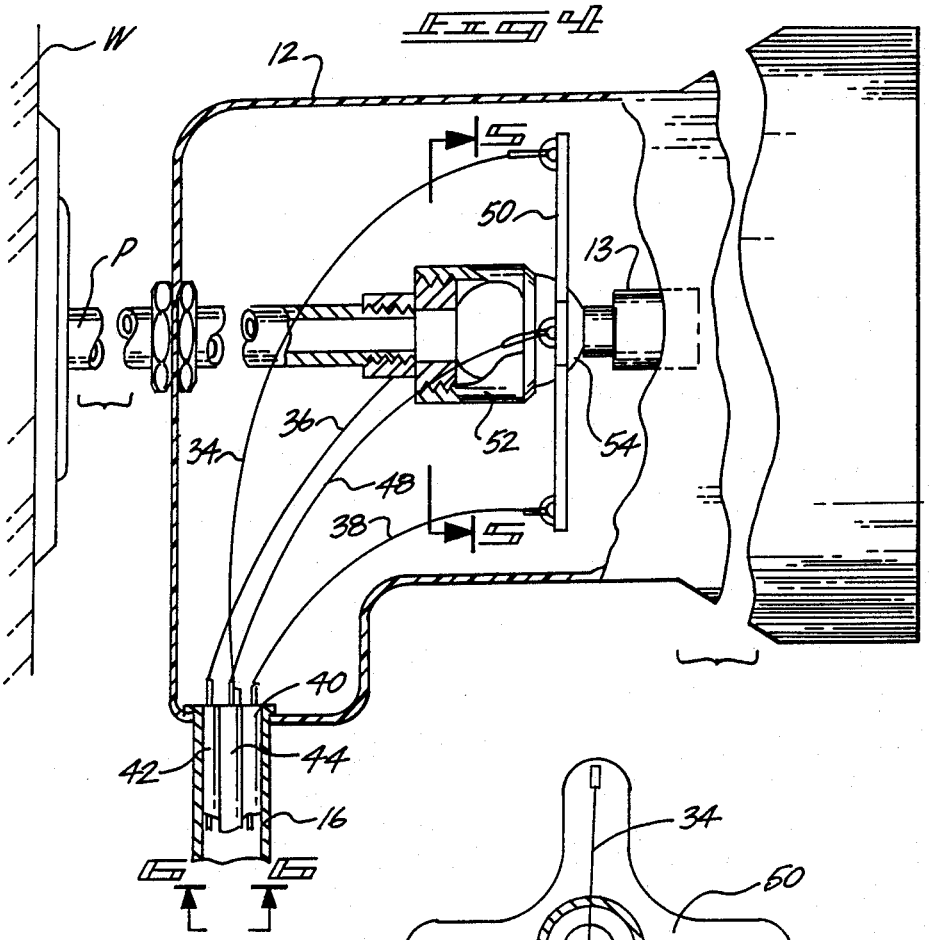
FIG. 4 is a cross sectional view, taken along line 4—4 of FIG. 1, which illustrates the constructional details of the pivotal shower head.

FIG. 4 provides a cross sectional illustration of the adjustable shower head. A stationary housing 12 is secured to the water supply pipe P by conventional threaded fasteners. An upper end of the rigid tube 16 communicates with the interior of the shower head housing 12 and encloses a ball 54 and socket 52 pivot mounting for an adjustable shower head 13. The housing 12 has an open front portion through which the pivotally adjustable shower head 13 extends. It is to be understood that conventional sealing means such as a flexible boot may be provided to prevent entry of water into the interior of the housing 12. While the illustrated embodiment depicts the pivot ball 54 secured to the adjustable shower head 13 and the pivot socket 52 secured to the water supply pipe P, it is to be understood that the pivot socket may instead be secured to the shower head 13 and the pivot ball secured to the pipe P, without departing from the scope of the present invention. Such pivotal shower head mountings are well known in the prior art and may be of the type disclosed in U.S. Pat. No. 4,282,612, the disclosure of which is hereby incorporated by reference. A control yoke 50 is secured adjacent the pivot ball 54 to the adjustable shower head 13. The control yoke 50 may be formed as a cross with four arms spaced in ninety degree intervals, or may be formed alternatively as a square plate. In either case, upper ends of the four control cables 34, 36, 38 and 48 are secured in a common plane at ninety degree intervals around the control yoke 50. The positions of the upper ends of the four control cables on the control yoke 50 are oriented one hundred and eighty degrees from the respective lower cable end positions on the master yoke 30 within the remote control housing 14.

With reference now to FIGS. 2 and 4, the effect of this orientation will now be described. For example, when the control knob 18 is moved downwardly, the control cable 38 will be tensioned. As may be seen in FIG. 4, tensioning of the upper end of the cable 38 will cause the shower head 13 to be also pivoted downwardly, in correspondence with the downward movement of the control knob 18. As may now be apprehended, the movement of the control knob 18 in any direction will cause a corresponding movement of the shower head 13.

Figure 5:
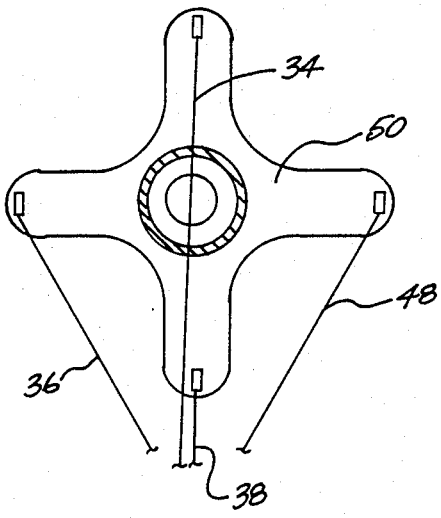
FIG. 5 is a partial cross sectional view, taken along line 5—5 of FIG. 4, which illustrates the pivotal control yoke of the adjustable shower head.

FIG. 5 illustrates the control yoke 50 and attached upper control cable ends 34, 36, 38 and 48.

Figure 6:
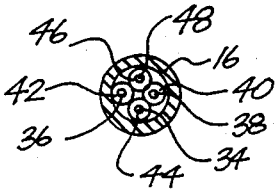
FIG. 6 is a cross sectional view, taken along line 6—6 of FIG. 4, which illustrates the control cables received within individual sheaths and enclosed within a rigid tube.

FIG. 6 provides a cross sectional illustration which depicts the control cables 34, 36, 38 and 48 respectively received for longitudinal reciprocal sliding movement within fixed sheaths 44, 42, 40 and 46. The cable sheaths and control cables are received within the interior of the rigid tubes 16, which may be bent at any angular orientation at selected intervals to allow positioning of the remote control housing 14 at any selected position within a shower enclosure.

Figure 7:
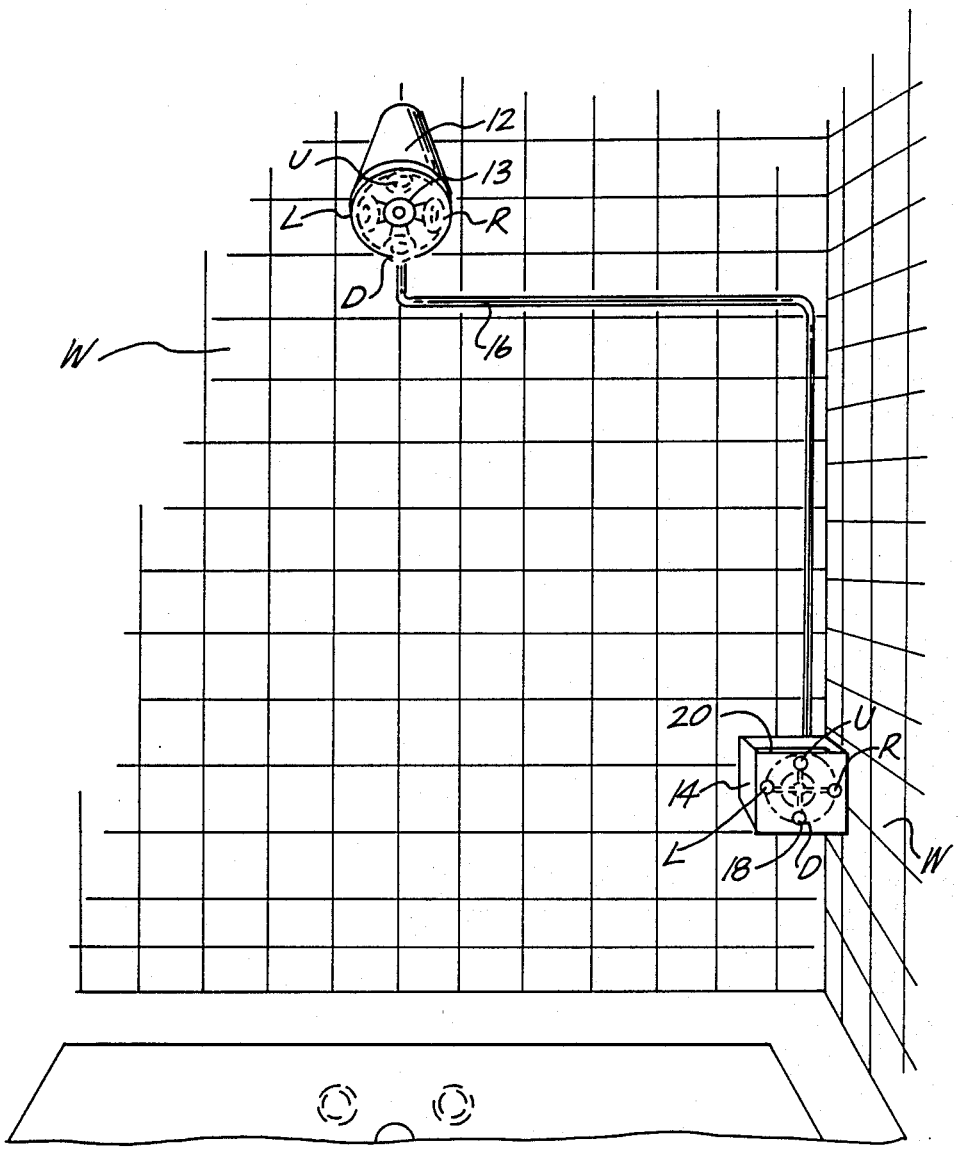
FIG. 7 is a partial perspective view which illustrates the manner of operation of the remotely adjustable shower head of the present invention.

FIG. 7 provides a perspective view which illustrates the manner of usage of the adjustable shower head of the present invention. When the control knob 18 is moved upwardly as indicated by U, the adjustable shower head 13 moves upwardly within the stationary housing 12 as also indicated by U. Left L, right R, and downward D movement of the control knob 18 produces corresponding movement of the shower head 13. The remote control housing 14 may be easily retrofitted by mounting on any of the walls W of an existing shower enclosure. Alternatively, during remodelling or during new construction, the rigid tube 16 may extend behind the walls W and thus remain hidden from view. The rigid tube 16 may be formed from plastic or a corrosion resistant metal. As may now be appreciated, the present invention provides an inexpensive device which enables remote adjustment of a shower head by handicapped individuals and small children.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable shower head, comprising:

a stationary shower head housing having an open front portion;

a shower head mounted by a ball and socket mechanism for pivotal adjustment within said shower head housing, said shower head extending through said open front portion;

a control yoke secured to said shower head within said shower head housing;

an upper end of an elongated rigid hollow tube secured to said shower head housing;

four elongated cable sheaths secured within said tube;

an elongated control cable received for longitudinal reciprocal sliding movement in each of said sheaths;

an upper end of each of said cables secured to said control yoke, said upper cable ends spaced in a common plane at ninety degree intervals around said control yoke;

a remote control housing;

a soap receptacle on an upper surface of said housing;

a joystick control lever mounted by a ball and socket mechanism for pivotal adjustment within said remote control housing;

a control knob on an end of said joystick control lever extending exteriorly of said remote control housing;

a master yoke secured to said joystick control lever within said remote control housing;

a lower end of said elongated hollow tube secured to said remote control housing;

a lower end of each of said cables secured to said master yoke, said lower cable ends spaced in a common plane at ninety degree intervals around said master yoke;

each of said lower cable ends oriented one hundred eighty degrees from the respective upper cable end position on said control yoke, whereby movement of said control knob in any direction moves said shower head in a corresponding direction.

2. An adjustable shower head, comprising:

a shower head mounted for pivotal adjustment;

a remotely disposed pivotally mounted joystick;

a control yoke secured to said joystick;

a rigid hollow tube extending between said shower head and said joystick;

four elongated cable sheaths secured within said tube;

an elongated control cable received for longitudinal reciprocal sliding movement in each of said sheaths;

an upper end of each of said cables secured to said control yoke, said upper cable ends spaced in a common plane at ninety degree intervals around said control yoke;

a lower end of each of said cables secured to said master yoke, said lower end spaced in a common plane at ninety degree intervals around said master yoke; and each of said lower cable ends oriented one hundred and eighty degrees from the respective upper cable end position on said control yoke, whereby movement of said joystick in any direction moves said shower head in a corresponding direction.

3. The adjustable shower head of claim 2, wherein said shower head is mounted for pivotal adjustment by a ball and socket mechanism.

4. The adjustable shower head of claim 2, wherein said joystick is mounted for pivotal adjustment by a ball and socket mechanism.

* * * * *